US006731075B2

(12) United States Patent
Pak

(10) Patent No.: US 6,731,075 B2
(45) Date of Patent: May 4, 2004

(54) METHOD AND APPARATUS FOR LIGHTING A DISCHARGE LAMP

(75) Inventor: Veniamin A Pak, Tashkent (UZ)

(73) Assignee: AMPR LLC, Las Vegas, NV (US)

( * ) Notice: Subject to any disclaimer, the term of this patent is extended or adjusted under 35 U.S.C. 154(b) by 13 days.

(21) Appl. No.: 10/205,290

(22) Filed: Jul. 23, 2002

(65) Prior Publication Data

US 2003/0085669 A1 May 8, 2003

Related U.S. Application Data

(60) Provisional application No. 60/339,717, filed on Nov. 2, 2001.

(51) Int. Cl.[7] ..... H05B 41/16

(52) U.S. Cl. ..... 315/274; 315/279; 315/282; 315/276

(58) Field of Search ..... 315/274, 278, 315/279, 282, 287, 360, 224, 225, 209 R, 200 R, 291, 276

(56) References Cited

U.S. PATENT DOCUMENTS

| | | | |
|---|---|---|---|
| 3,691,450 A | 9/1972 | Cox | 321/45 R |
| 3,778,677 A | 12/1973 | Kriege | 315/219 |

(List continued on next page.)

FOREIGN PATENT DOCUMENTS

| | | |
|---|---|---|
| EP | 0 585 727 A1 | 3/1994 |
| RU | 1457821 | 9/1992 |
| WO | WO 90/09087 | 8/1990 |

OTHER PUBLICATIONS

Copy of Annex to Form PCT/ISA/206—Communication Relating to the Results of the Partial International Search (PCT/US 02/35157).

(List continued on next page.)

*Primary Examiner*—Tuyet T. Vo
(74) *Attorney, Agent, or Firm*—Knobbe Martens Olson & Bear LLP

(57) ABSTRACT

A reliable and efficient circuit for lighting a discharge lamp is described. An inverter accepts a direct current supply voltage and outputs an alternating current lamp voltage to drive the discharge lamp at a relatively high frequency. In one embodiment, the inverter includes semiconductor switches in a full-bridge configuration, a transformer feedback circuit to control the semiconductor switches, and a series L-C resonant circuit. In one embodiment, the inverter includes semiconductor switches in a half-bridge configuration, a transformer feedback circuit to control the semiconductor switches, and a series L-C resonant circuit. The inverter can drive multiple discharge lamps in a parallel configuration. A bypass circuit can also be coupled across a cathode of the discharge lamp to extend the life of the discharge lamp. The bypass circuit activates when a lamp cathode wears out.

20 Claims, 5 Drawing Sheets

U.S. PATENT DOCUMENTS

| | | | | |
|---|---|---|---|---|
| 3,818,312 | A | 6/1974 | Luursema et al. | 321/44 |
| 4,075,476 | A | 2/1978 | Pitel | 315/209 R |
| 4,104,715 | A | 8/1978 | Lawson, Jr. | 363/37 |
| 4,319,164 | A | 3/1982 | Tulleners | 315/219 |
| 4,353,009 | A | 10/1982 | Knoll | 315/220 |
| 4,408,270 | A | 10/1983 | Anderson et al. | 363/132 |
| 4,459,516 | A | 7/1984 | Zelina et al. | 315/209 R |
| 5,051,661 | A | 9/1991 | Lee | 315/225 |
| 5,124,619 | A | 6/1992 | Moisin et al. | 315/219 |
| 5,166,579 | A | 11/1992 | Kawabata et al. | 315/209 R |
| 5,397,965 | A | 3/1995 | Gorille et al. | 315/209 R |
| 5,402,043 | A | 3/1995 | Nilssen | 315/307 |
| 5,414,327 | A | 5/1995 | Reijnaerts | 315/219 |
| 5,422,546 | A | 6/1995 | Nilssen | 315/219 |
| 5,426,349 | A | 6/1995 | Nilssen | 315/219 |
| 5,459,375 | A | 10/1995 | Nilssen | 315/247 |
| 5,481,160 | A | 1/1996 | Nilssen | 315/290 R |
| 5,483,127 | A | 1/1996 | Widmayer et al. | 315/307 |
| 5,559,394 | A | 9/1996 | Wood | 315/224 |
| 5,589,742 | A | 12/1996 | Ueda | 315/307 |
| 5,757,142 | A | 5/1998 | Kong | 315/224 |
| 5,844,378 | A | 12/1998 | LoCascio et al. | 315/307 |
| 5,929,573 | A * | 7/1999 | Louwers et al. | 315/219 |
| 5,939,836 | A | 8/1999 | Mita et al. | 315/224 |
| 5,959,408 | A | 9/1999 | Steel et al. | 315/106 |

OTHER PUBLICATIONS

McGraw–Hill–Encyclopedia of Science & Technology (5$^{th}$ Edition, 1982) topic entitled *Fluorescent Lamp*, pp. 515–517.

David P. Stern & Mauricio Peredo, article entitled #7a. *The Fluorescent Lamp: A Plasme You Can Use*, dated Feb. 16, 2001, http://www–istp.gsfc.nasa.gov/Education/wflour.html.

Chapter 6 of BOM1 1994, 3$^{rd}$ qtr., entitled *Lighting Systems*, pp. 6–21 to 6–23, 6–25, 6–29 to 6–30; 6–32–6–39.

Article entitled *How to Fix a Fluorescent Tube*, dated Apr. 24, 2000; http://www.otol.fl/–oltaja00/english/fluoresc.htm.

TAB books, Division of McGraw–Hill, Inc., article entitled *Build Your Own Laser, Phaser, Ion Ray Gun & Other Working Space–Age Projects*; by Robert E. Iannini; pp. 212, 213, 262 through 267; copyright 1983.

Abraham I. Pressman, *Switching Power Supply Design*, 2$^{nd}$ ed., 1998, pp. 93–101.

* cited by examiner

METHOD AND APPARATUS FOR LIGHTING A DISCHARGE LAMP

RELATED APPLICATION

The present application claims priority to co-pending provisional application entitled START REGULATING DEVICE FOR DISCHARGE LAMPS, application Ser. No. 60/339,717, filed Nov. 2, 2001, which is hereby incorporated by reference.

BACKGROUND OF THE INVENTION

1. Field of the Invention

The present invention relates to a circuit for lighting a discharge lamp and, in particular, refers to an electronic ballast circuit for fluorescent lamps.

2. Description of the Related Art

Discharge lamps (for example, fluorescent lamps) provide light in numerous commercial, industrial, and consumer applications. The discharge lamps are illuminated when driven by an alternating current (AC) signal, such as signals from a power line which oscillate at a relatively low frequency (for example, 60 Hertz). The discharge lamps typically need a ballast circuit (for example, a magnetic ballast circuit) to interface with the power line. The ballast circuit for low frequency operation is generally bulky and operates the discharge lamps inefficiently.

Electronic ballast circuits have been introduced to increase power efficiency of the discharge lamps by converting the power line signal to a relatively higher frequency AC signal and driving the discharge lamps with the relatively higher frequency AC signal. The higher frequency AC signal requires less current to flow through the discharge lamps to achieve the same light output, and lower current flows can lengthen the life of the discharge lamps. Generally, electronic ballast circuits are much more expensive than magnetic ballast circuits.

Discharge lamps with filaments at opposite ends generally become inoperable when one or both filaments are worn out (or burned out). The burnt out discharge lamps are typically replaced with new discharge lamps. The burnt out discharge lamps need to be handled carefully because they may contain harmful elements, such as mercury. Improper handling during disposal of the discharge lamps can cause the mercury to inadvertently leak and contaminate the environment.

SUMMARY OF THE INVENTION

The present invention solves these and other problems by providing a compact, cost-effective, efficient, and reliable circuit which is compatible with existing lighting systems for discharge lamps. In one embodiment, an energy efficient ballast (or an electronic ballast) drives a discharge lamp, such as, for example, a T-8 or T-12 fluorescent lamp. The energy efficient ballast includes an inverter (or an oscillator or a converter) which accepts a substantially direct current (DC) input voltage and provides a substantially AC output voltage to drive the discharge lamp at a relatively high frequency. In one embodiment, the DC input voltage is provided by a full-wave rectifier circuit coupled to an AC power line. The amplitude of the DC input voltage or the AC power line can be varied to provide brightness control (or dimming) of the discharge lamp.

In one embodiment, the inverter includes semiconductor switches in a full-bridge (or an H-bridge) configuration. For example, a first semiconductor switch is coupled between a positive terminal of the DC input voltage and a first node. A second semiconductor switch is coupled between the first node and a negative terminal of the DC input voltage. A third semiconductor switch is coupled between the positive terminal of the DC input voltage and a second node. Finally, a fourth semiconductor switch is coupled between the second node and the negative terminal of the DC input voltage.

In one embodiment, the inverter includes semiconductor switches in a half-wave bridge (or push-pull) configuration. For example, a first semiconductor switch is coupled between a positive terminal of the DC input voltage and a first node. A second semiconductor switch is coupled between the first node and a negative terminal of the DC input voltage. The lamp load is provided between the first node and a neutral (e.g., a ground or virtual-ground) node.

The inverter also includes a feedback control circuit which senses the current through the discharge lamp to control the semiconductor switches. For example, a sensing element is coupled in series with the discharge lamp. In one embodiment, the feedback control circuit is a transformer, and the sensing element is a primary winding of the transformer. Secondary windings of the transformer are coupled to control inputs (or control terminals) of the semiconductor switches.

In one embodiment, the semiconductor switches are realized with bipolar transistors. For example, base terminals of the bipolar transistors are coupled to the respective secondary windings of the transformers. In one embodiment, respective resistors are coupled in series with the base terminals and emitter terminals to limit currents through the semiconductor switches to safe levels.

In one embodiment, the primary winding of the transformer is coupled between the first node and a first cathode (or an electrode or a filament) of the discharge lamp. A timing capacitor (or an initiating capacitor) is coupled between the first cathode and a second cathode of the discharge lamp. An inductor (or a choke coil) is coupled between the second cathode of the discharge lamp and the second node.

The semiconductor switches alternately conduct to provide the AC output voltage to the discharge lamp at a frequency determined by the timing capacitor and the inductor. For example, the first semiconductor switch and the fourth semiconductor switch operate as a first pair to provide a voltage of a first polarity to the discharge lamp. The second semiconductor switch and the third semiconductor switch operate as a second pair to provide a voltage of a second polarity to the discharge lamp.

In one embodiment, a start-up circuit is coupled to the inverter for reliable operations. The start-up circuit automatically provides a pulse (or a trigger signal) to the feedback control circuit of the inverter to initialize the sequence of operation for the semiconductor switches when necessary. For example, the trigger signal is provided to one of the secondary windings of the transformer or to the control terminal of one of the semiconductor switches.

In one embodiment, the start-up circuit includes a capacitor which charges at a relatively slow rate in comparison to the operating frequency of the inverter. The charging capacitor raises a voltage of an avalanche device which outputs the trigger signal when the voltage reaches a predetermined level. Once the inverter is operating, the start-up circuit is relatively inactive.

In one embodiment, a multi-lamp ballast operates multiple discharge lamps. The multi-lamp ballast includes a multi-lamp inverter, similar to the inverter described above, with a plurality of semiconductor switches in a full-bridge or half-bridge configuration and a feedback control circuit for operating the semiconductor switches. However, the multi-lamp inverter includes multiple timing capacitors and inductors. The timing capacitors are coupled across cathodes of each of the respective discharge lamps. The inductors are coupled in series with each of the respective discharge lamps. The inductor-capacitor-discharge lamp combinations are coupled in parallel for operation.

In one embodiment, a bypass circuit (or a back-up circuit or a redundant circuit) is coupled across leads (or pins or terminals) of a cathode of the discharge lamp to extend the life the discharge lamp, thereby reducing its disposal rate. The bypass circuit advantageously extends the life of the discharge lamp without retrofit. The bypass circuit is substantially inactive when the cathode is operational. When the cathode wears out or becomes inoperable, the bypass circuit automatically activates to provide a conductive path for continuing operation of the discharge lamp. In one embodiment, the bypass circuit includes a pair of diodes placed in parallel opposition.

In one embodiment, a thermistor serves to limit the current supplied by the electronic ballast oscillator when there is no discharge lamp.

These and other objects and advantages of the present invention will become more fully apparent from the following description taken in conjunction with the accompanying drawings.

In the figures, the first digit of any three-digit number generally indicates the number of the figure in which the element first appears.

DETAILED DESCRIPTION

Figure 1:
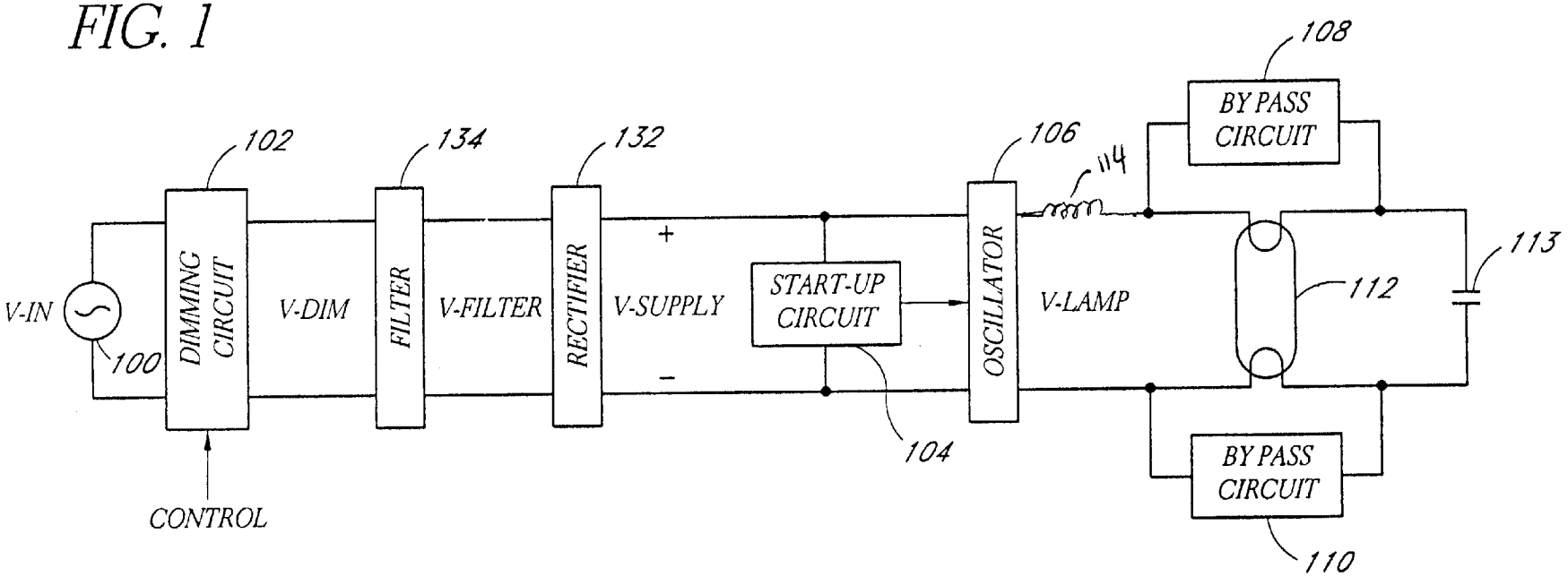
FIG. 1 is a block diagram of one embodiment of a lighting system for driving a discharge lamp.

Embodiments of the present invention will be described hereinafter with reference to the drawings. FIG. 1 is a block diagram of one embodiment of a lighting system for driving a wide range of discharge lamps 112, such as, for example, fluorescent lamps. The lighting system advantageously accepts a wide range of input voltages (including for example, AC input signals from a power line) and produces an AC output signal with a frequency and/or voltage that can be different from the AC input signal provided by the power line. The lighting system can include an optional dimming circuit 102, a filter circuit 134, a rectifier circuit 132, a start-up circuit 104, an oscillator circuit 106, and bypass circuits 108, 110. In one embodiment, the bypass circuits 108, 110 comprise back-to-back diodes. In one embodiment, the bypass circuits 108, 110 comprise capacitors.

In one embodiment, the dimming circuit 102 is coupled to an AC input voltage (V-IN) 100 of relatively low frequency (for example, a 50 Hertz or 60 Hertz signal on a power line). The dimming circuit 102 accepts a control signal (CONTROL) to adjust the brightness of the discharge lamp 112 during operations. In one embodiment, the dimming circuit 102 is a voltage regulator which varies the amplitude of the AC input voltage 100 in response to the control signal. For example, the dimming circuit 102 reduces the amplitude of the AC input voltage 100 to dim the discharge lamp 112. The dimming circuit 102 produces an adjusted AC output voltage (V-DIM).

The filter circuit 134 is coupled to the output of the dimming circuit 102 and produces a filtered AC output voltage (V-FILTER). The rectifier circuit 132 is coupled to the output of the filter circuit 134 and produces a substantially DC output voltage (V-SUPPLY). The start-up circuit 104 and the oscillator circuit 106 are both coupled to the output of the rectifier circuit 132. The start-up circuit 104 outputs a trigger signal to the oscillator circuit 106. The oscillator circuit 106 outputs a substantially AC output voltage (V-LAMP) of relatively high frequency (advantageously about or greater than 20 Kilo-Hertz) to the discharge lamp 112.

In one embodiment, the discharge lamp 112 is a fluorescent lamp with a bi-pin base (a pair of external pins coupled to a filament on each end of a tubular bulb). The outputs of the oscillator circuit 106 are coupled to the pairs of external pins. For example, a first output of the oscillator circuit 106 is coupled through an inductor 114 to a first pin of a first filament and a second output of the oscillator circuit 106 is coupled to a second pin of a second filament. A timing capacitor 113 is coupled between a second pin of the first filament and a first pin of the second filament. The timing capacitor 113 can be considered as a part of the oscillator circuit 106 but is shown externally for convenience of illustration and clarity.

In one embodiment, bypass circuits 108, 110 are coupled across the respective pairs of pins to extend the life of the discharge lamp 112. The bypass circuits 108, 110 and the other circuits are discussed in detail in the paragraphs below.

Figure 2:
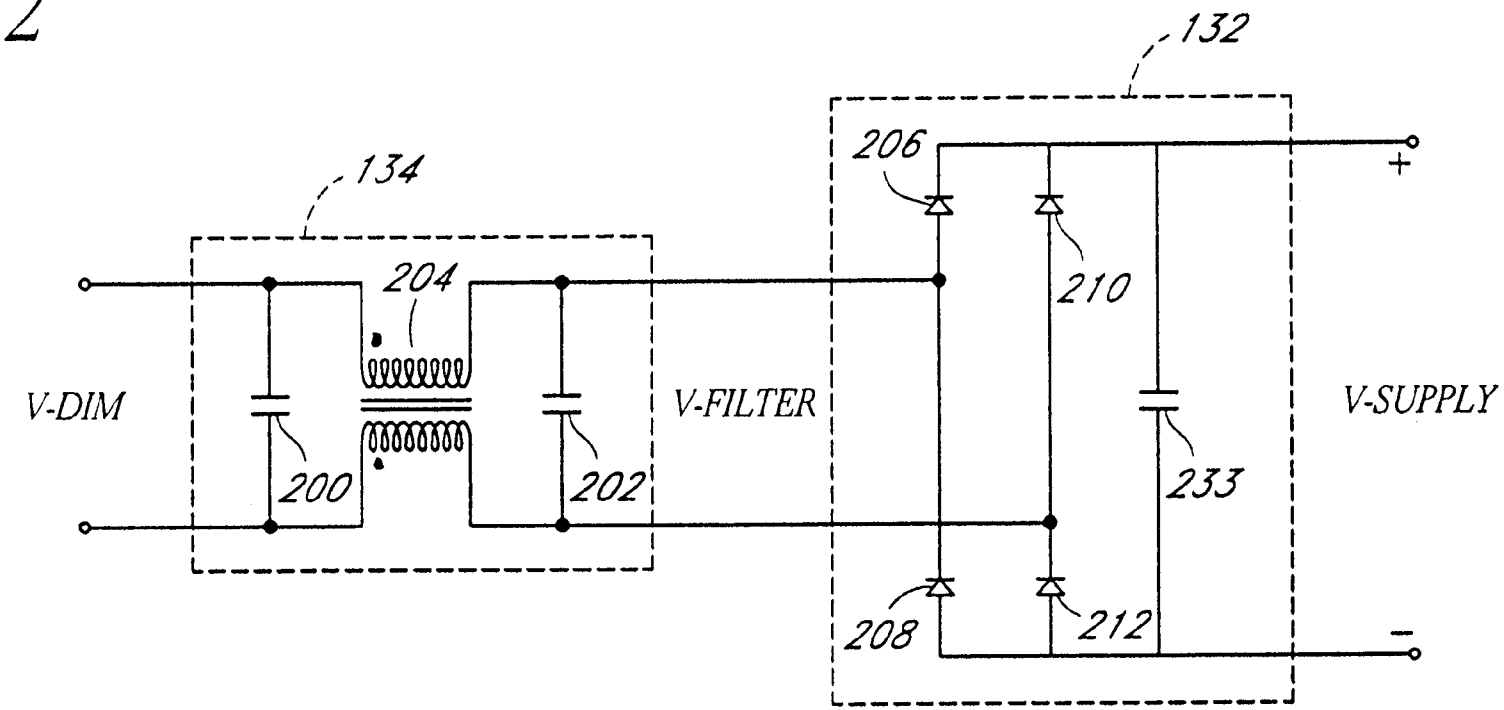
FIG. 2 is a schematic diagram of one embodiment of a filter circuit and a rectifier circuit shown in FIG. 1.

FIG. 2 is a schematic diagram of one embodiment of the filter circuit 134 and the rectifier circuit 132 shown in FIG. 1. In one embodiment, the filter circuit 134 is a radio frequency (RF) or high frequency filter. The filter circuit 134 suppresses high frequency signals (meaning signals above a few hundred Hertz) on the AC input voltage 100 to avoid interference with operations of other electrical devices (such as radios or televisions) coupled to the same AC input voltage 100.

In one embodiment, the filter circuit 134 is realized with a common mode inductor 204 and two capacitors 200, 202. The first capacitor 200 is coupled in parallel with input terminals of the filter circuit 134. The second capacitor 202 is coupled in parallel with output terminals of the filter circuit 134. The common mode inductor 204 is coupled between the input terminals and the output terminals of the filter circuit 134.

The rectifier circuit 132 is typically a full-wave rectifier. In one embodiment, the rectifier circuit 132 is realized with diodes 206, 208, 210, 212 in a bridge configuration. For example, a first diode 206 has an anode coupled to a first input terminal (or a positive input terminal) and a cathode coupled to a first output terminal (or a positive output terminal) of the rectifier circuit 132. A second diode 208 has an anode coupled to a second output terminal (or a negative output terminal) and a cathode coupled to the positive input terminal of the rectifier circuit 132. A third diode 210 has an anode coupled to a second input terminal (a negative input terminal) and a cathode coupled to the positive output terminal of the rectifier circuit 132. Finally, a fourth diode 212 has an anode coupled to the negative output terminal and a cathode coupled to the negative input terminal of the rectifier circuit 132.

The rectifier circuit 132 includes a filtering capacitor 233 coupled in parallel with the output terminals. The filtering capacitor 233 minimizes ripples in the substantially DC output voltage (V-SUPPLY) of the rectifier circuit 132.

Figure 3:
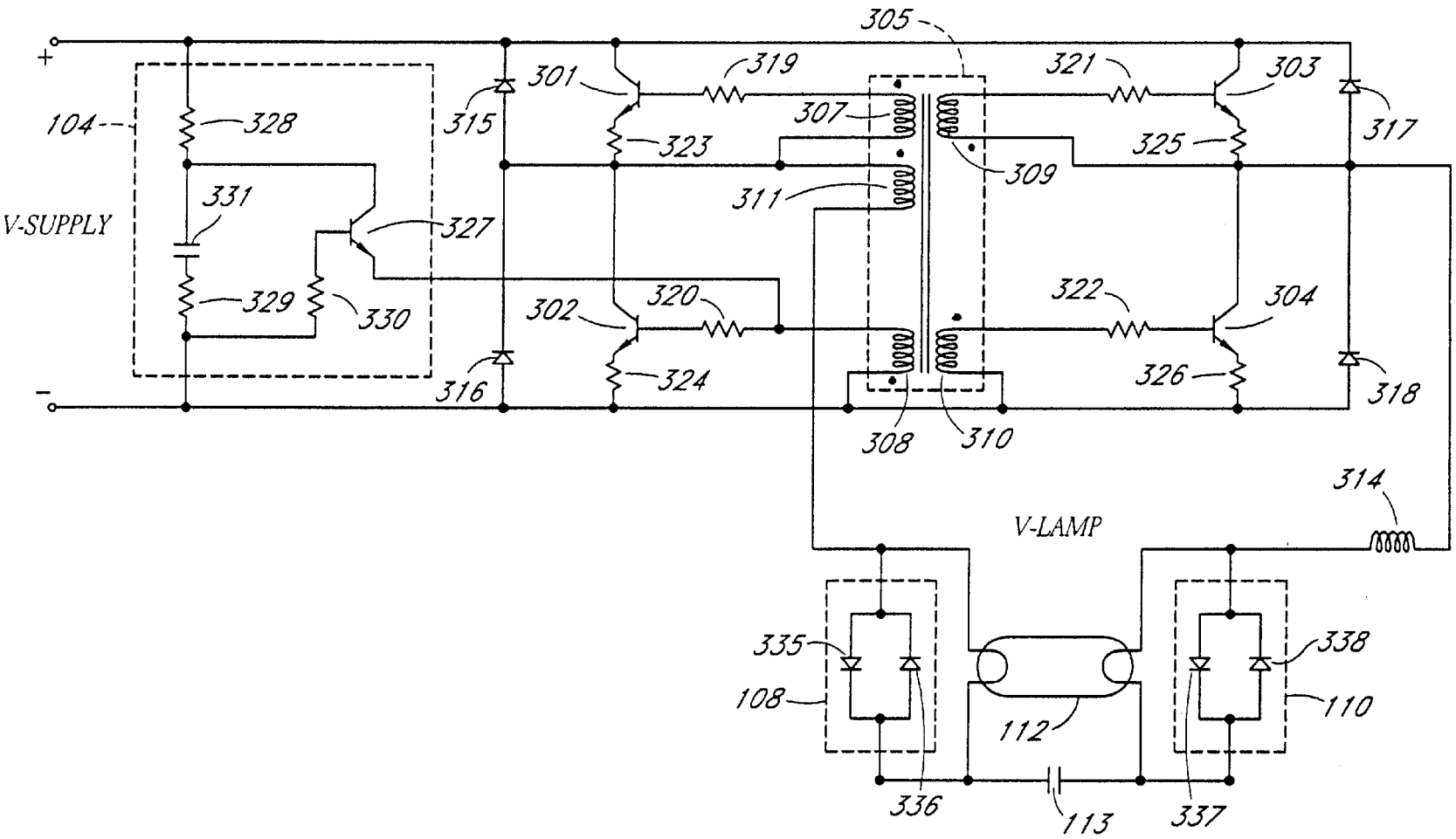
FIG. 3 is a schematic diagram of one embodiment of a start-up circuit, an oscillator circuit, and bypass circuits shown in FIG. 1.

FIG. 3 is a schematic diagram of one embodiment of the start-up circuit 104, the oscillator circuit 106, and the bypass circuits 108, 110 shown in FIG. 1. The start-up circuit 104, the oscillator circuit 106, and the bypass circuits 108, 110 can advantageously be assembled on a printed circuit board of a relatively small size. For example, the circuits can be fitted inside a housing measuring less than five inches by two inches by two inches.

The oscillator circuit (or inverter) 106 converts a substantially DC supply voltage (V-SUPPLY) to a substantially AC output voltage (V-LAMP) to drive the discharge lamp 112. In one embodiment, the inverter 106 is realized using semiconductor switching circuits in a full-bridge (or an H-bridge) configuration, a feedback control circuit to control the semiconductor switching circuits, and a series L-C resonant circuit.

In one embodiment, the semiconductor switching circuits are advantageously realized using npn bipolar transistors 301, 302, 303, 304. For example, a first transistor 301 has a collector terminal coupled to a positive input terminal and an emitter terminal coupled to a first node via a series emitter resistor 323. A second transistor 302 has a collector terminal coupled to the first node and an emitter terminal coupled to a negative input terminal via a series emitter resistor 324. A third transistor 303 has a collector terminal coupled to the positive input terminal and an emitter terminal coupled to a second node via a series emitter resistor 325. Finally, a fourth transistor 304 has a collector terminal coupled to the second node and an emitter terminal coupled to the negative input terminal via a series emitter resistor 326.

Clamping diodes 315, 316, 317, 318 can be included to limit voltages at the first and second nodes. For example, the first clamping diode 315 has an anode coupled to the first node and a cathode coupled to the positive input terminal. The second clamping diode 316 has an anode coupled to the negative input terminal and a cathode coupled to the first node. The third clamping diode 317 has an anode coupled to the second node and a cathode coupled to the positive input terminal. Finally, the fourth clamping diode 318 has an anode coupled to the negative input terminal and a cathode coupled to the second node.

The first clamping diode 315 limits the maximum voltage at the first node to one diode drop (or a forward voltage drop of one diode) above the positive input terminal. The second clamping diode 316 limits the minimum voltage at the first node to one diode drop below the negative input terminal. Similarly, the third clamping diode 316 limits the maximum voltage at the second node to one diode drop above the positive input terminal, and the fourth clamping diode 318 limits the minimum voltage at the second node to one diode drop below the negative input terminal.

In one embodiment, the feedback control circuit is realized using a transformer 305. A primary winding 311 of the transformer 305 is coupled between the first node and a first terminal of a first cathode of the discharge lamp 112. A timing capacitor 113 is coupled between a second terminal of the first cathode and a first terminal of a second cathode of the discharge lamp 112. An inductor 314 is coupled between a second terminal of the second cathode and the second node.

Secondary windings 307, 308, 309, 310 of the transformer 305 are coupled to respective base terminals of the transistors 301, 302, 303, 304 to control the conduction states of the transistors 301, 302, 303, 304. For example, the first secondary winding 307 is coupled to the base of the first transistor 301 via a series base resistor 319. The second secondary winding 308 is coupled to the base of the second transistor 302 via a series base resistor 320. The third secondary winding 309 is coupled to the base of the third transistor 303 via a series base resistor 321. Finally, the fourth secondary winding 310 is coupled to the base of the fourth transistor 304 via a series base resistor 322.

The series emitter resistors 323, 324, 325, 326 and the series base resistors 319, 320, 321, 322 limit currents conducted by the transistors 301, 302, 303, 304 to avoid excessive heating and to improve reliability of the inverter 106. In one embodiment, the series emitter resistors 323, 324, 325, 326 and the series base resistors 319, 320, 321, 322 can be eliminated.

The first secondary winding 307 and the fourth secondary winding 310 make a first set of secondary windings. The voltages of the first set of secondary windings are in phase with each other. The second secondary winding 308 and the third secondary winding 309 make a second set of secondary windings. The voltages of the second set of secondary windings are in phase with each other and are in opposite phase of the first set of secondary windings. Thus, the first transistor 301 and the fourth transistor 304 conduct substantially simultaneously as a pair. The second transistor 302 and the third transistor 303 conduct when the other two transistors 301, 304 are not conducting. The primary winding 311 senses the current of the discharge lamp 112 to determine which pairs of transistors to activate.

The inverter 106 is a bi-stable circuit (has two stable operational modes). The inverter 106 is designed to be stable at a desired operational mode. The inverter 106 is also stable at a zero-current non-operational mode. The start-up circuit 104 is used in one embodiment to prevent the inverter 106 from the zero-current non-operational mode. For example, the start-up circuit 104 activates to help the inverter 106 reach the desired operational mode upon power-up or reset. After the inverter 106 reaches the desired operational mode, the start-up circuit 104 becomes inactive and does not interfere with normal operations of the inverter 106.

In one embodiment, the start-up circuit 104 is a relaxation oscillator realized with an avalanche device 327. For example, a first resistor 328 is coupled to a positive input terminal of a supply voltage (V-SUPPLY) and a second resistor 329 is coupled to a negative input terminal of the supply voltage. A charging capacitor 331 is coupled between the first resistor 328 and the second resistor 329. In one embodiment, the avalanche device 327 is a npn bipolar transistor. The avalanche transistor 327 has a collector terminal coupled to a node commonly connecting the first resistor 328 and the charging capacitor 331. A base terminal of the avalanche transistor 327 is coupled to the negative input terminal via a resistor 330. In one embodiment, an emitter terminal of the avalanche transistor 327 is coupled to a node commonly connecting the second secondary winding 308 and the second series base resistor 320.

The relaxation oscillator 104 outputs a current pulse whenever the charging capacitor 331 reaches a predetermined voltage level and the inverter 106 is not oscillating. For example, the potential of the emitter terminal of the avalanche transistor 327 is substantially close to or slightly below the potential of the negative input terminal when the inverter 106 is not oscillating. When power is provided to the relaxation oscillator 104 via the supply voltage, the charging capacitor 331 charges at a rate limited by the values of the first resistor 328 and the second resistor 329, and the voltage across the charging capacitor 331 rises.

When the charging capacitor 331 reaches a relatively high voltage that causes the avalanche transistor 327 to go into avalanche mode (for example, 50 volts across the collector-emitter junction), the avalanche transistor 327 begins to conduct and deplete the charging capacitor 331 at a rate limited by the second resistor 329. A relatively fast current pulse is produced at the emitter terminal of the avalanche transistor 327. The fast current pulse reliably starts the inverter 106 by forcing the second transistor 302 and the third transistor 303 to conduct. The inverter 106 can begin to self-oscillate once conduction begins.

When the inverter 106 begins oscillating, the avalanche transistor 327 conducts a slight leakage current and the charging capacitor 331 does not have sufficient current to charge up to the relatively high voltage for avalanche operation. However, the charging capacitor 331 can begin to charge again when the inverter 106 stops oscillating. Thus, the start-up circuit 104 quickly and reliably starts the inverter 106 and ensures stable operation of the inverter 106 once power is provided to turn on the discharge lamp 112.

The inverter 106 oscillates at a relatively faster rate for efficient operation. For example, the inverter 106 can oscillate at a frequency between 25–35 Kilo-Hertz which is above the audible frequency range. Higher frequency of operation (generally 50–100 Kilo-Hertz) is also possible and can lead to more efficient operation of the discharge lamp 112. However, components in the inverter 106 exhibit higher losses at the higher frequencies. Thus, overall efficiency may be advantageously optimized in the range of 25–35 Kilo-Hertz. The frequency of operation can be adjusted by adjusting the value of the inductor 314.

When the inverter 106 initially starts and the discharge lamp has not ignited, current flows from the positive input terminal of the supply voltage through the third transistor 303, the series emitter resistor 325, the inductor 314, the second cathode of the discharge lamp 112, the timing capacitor 113, the first cathode of the discharge lamp 112, the primary winding 311, the second transistor 302, and the series emitter resistor 324. The inductor 314 and the timing capacitor 113 form a series resonant circuit. At start-up, the voltage (V-LAMP) across the cathodes of the discharge lamp 112 starts increasing in magnitude until the discharge lamp 112 strikes. The magnitude of the striking voltage can be several times the magnitude of the supply voltage. The relatively high striking voltage across the discharge lamp 112 results in an electrical arc across the cathodes of the discharge lamp 112 and ignites gases in the discharge lamp 112 to start producing light.

Once the discharge lamp 112 strikes, the lamp voltage decreases to a normal operating level (about 103–105 volts) and current begins to flow through the discharge lamp 112 in addition to the timing capacitor 113. The current flow changes over time, increasing in magnitude as the inductor 314 reacts to sudden changes in voltage polarity and then decreasing in magnitude as the timing capacitor 113 charges to full potential.

The primary winding 311 senses the current flow and alternately activates a set of semiconductor switches when the current flow reaches substantially a zero point to change the direction of the voltage and the current across the discharge lamp 112. Thus, the current feedback keeps the current flow, and thus the voltage across the discharge lamp 112, oscillating and approaching a sinusoidal waveform.

The bypass circuits 108, 110 are coupled across respective cathodes of the discharge lamp 112 to extend lamp life. In one embodiment, the bypass circuits 108, 110 are advantageously realized using a pair of diodes provided in parallel and in opposite directions. For example, the bypass circuit 108 includes a first diode 335 and a second diode 336. An anode of the first diode 335 is coupled to a cathode of the second diode 336, and an anode of the second diode 336 is coupled to a cathode of the first diode 335. The pair of diodes 335, 336 is coupled across input terminals of the first cathode of the discharge lamp 112. The bypass circuit 110 has a first diode 337 and a second diode 338 in a substantially similar configuration as the bypass circuit 108 described above. The pair of diodes 337, 338 is coupled across input terminals of the second cathode of the discharge lamp 112. In one embodiment, the diodes 335, 336 are replaced by a capacitor. In one embodiment, the diodes 337, 338 are replaced by a capacitor. In one embodiment, the diodes 335, 336 and/or 337, 338 are bypassed by a capacitor.

When the cathodes of the discharge lamp 112 are operational (conducting), the bypass circuits 108, 110 are substantially inactive. For example, the voltage across a conducting cathode is relatively small. The diodes 335, 336, 337, 338 are chosen with forward voltage drops (for example, two volts) that are higher than the voltage across a conducting cathode. Thus, the diodes 335, 336, 337, 338 normally do not conduct.

However, when one or both cathode wears out (or burns or breaks) such that it is no longer conducting electricity between the two pins, then the bypass circuits 108 and/or 110 operate to provide a conduction path. For example, when a cathode burns or breaks one or more of the diodes 335, 336, 337, 338 may conduct. For example, when the first cathode of the discharge lamp 112 wears out, a high impedance is presented across the terminals of the first cathode. The diodes 335, 336 provide back-up conductive paths between the terminals of the first cathode. The diodes 335, 336 alternately conduct depending on the polarity of the voltage across the discharge lamp 112. Similarly, the diodes 337, 338 alternately conduct when the second cathode of the discharge lamp 112 wears out.

The bypass circuits 108, 110 advantageously provide a cost-effective method of extending the life of the discharge lamp 112 without retrofit. The bypass circuits 108, 110 allow the lighting system to reliably re-light and continue operation of the discharge lamp 112 when one or both of the cathodes burn out.

Figure 4:
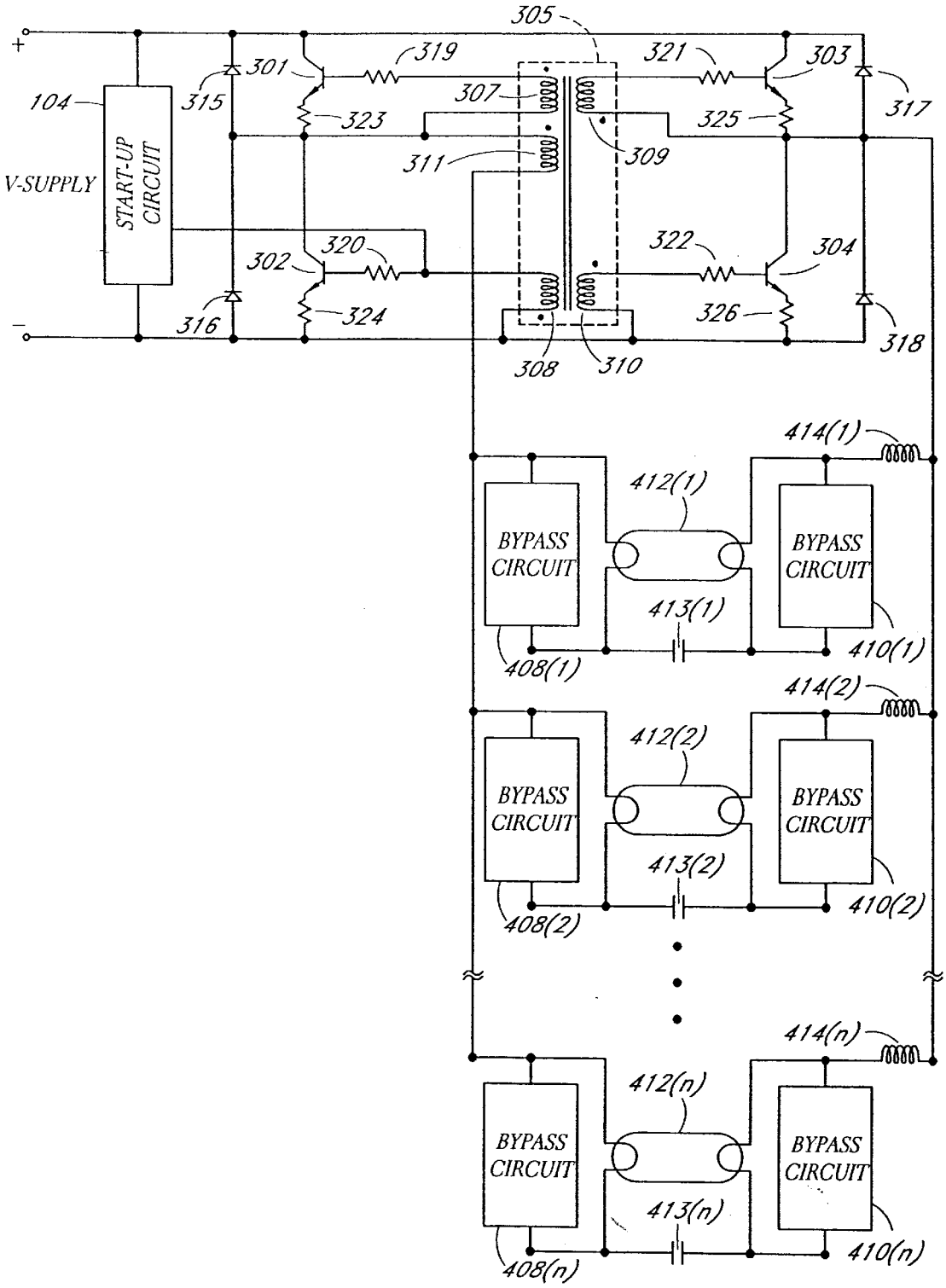
FIG. 4 illustrates one embodiment of an oscillator circuit driving multiple discharge lamps.

FIG. 4 illustrates one embodiment of an oscillator circuit driving multiple discharge lamps, shown as discharge lamps **412(1)–412(*n*) (collectively the discharge lamps 412). The oscillator circuit is substantially the inverter 106 shown in FIG. 3**, which is described above, with increased power ratings for the various components to account for the additional loads. The oscillator circuit also includes additional inductors and timing capacitors.

For example, n timing capacitors, shown as timing capacitors **413(1)–413(*n*) (collectively the timing capacitors 413), are coupled across first and second cathodes of the respective discharge lamps 412. N inductors, shown as inductors 414(1)–414(*n*) (collectively the inductors 414), are coupled in series with the respective second cathodes of the discharge lamps 412 and a second node of the oscillator circuit. The first cathodes of the discharge lamps 412** are commonly coupled to a first node of the oscillator circuit.

In one embodiment, n first bypass circuits, shown as first bypass circuits **408(1)–408(*n*) (collectively the first bypass circuits 408) are coupled across the respective first cathodes of the discharge lamps 412. Similarly, n second bypass circuits, shown as second bypass circuits 410(1)–410(*n*) (collectively the second bypass circuits 410) are coupled across the respective second cathodes of the discharge lamps 412**.

Figure 5:
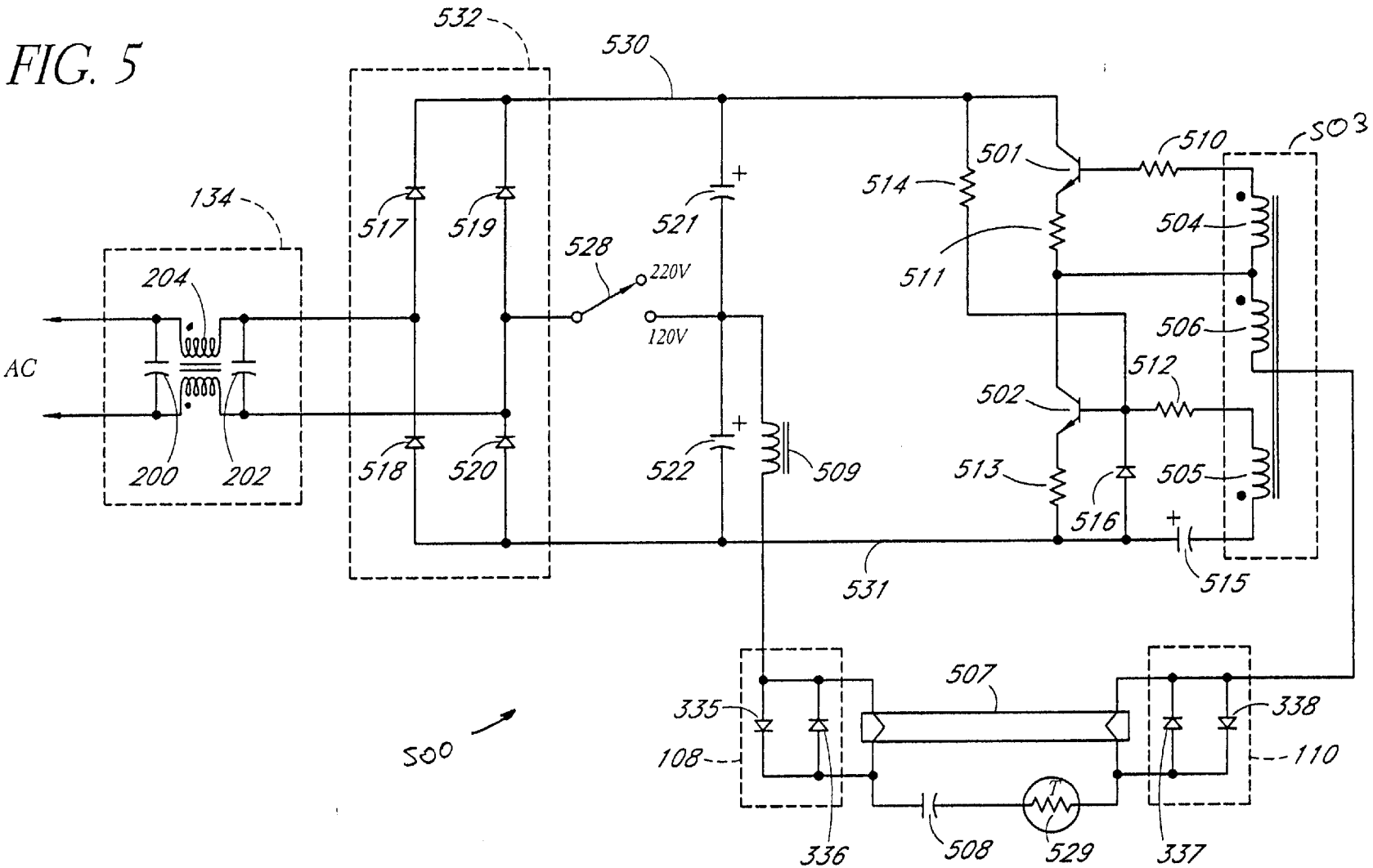
FIG. 5 shows an electronic ballast lighting system 500 for driving a discharge lamp by using a half-wave bridge and configured to operate from various AC line voltages (e.g., 120 volts or 220 volts).

FIG. 5 shows an electronic ballast lighting system 500 for driving a discharge lamp by using a half-wave bridge and configured to operate from various AC line voltages (e.g., 120 volts or 220 volts) provided through the filter circuit 134. The filter circuit 134 includes a common-mode inductor 204 and capacitors 200, 202. The first capacitor 200 is coupled in parallel with input terminals of the filter circuit 134. The second capacitor 202 is coupled in parallel with output terminals of the filter circuit 134. The common mode inductor 204 is coupled between the input terminals and the output terminals of the filter circuit 134.

An output of the filter circuit 134 is provided to a full-wave rectifier circuit 532 having diodes 517–520. The first diode 517 has an anode provided to a first output terminal of the filter circuit 134 and a cathode provided to a positive supply line 530. The second diode 518 has an anode provided to a negative supply line 531 and a cathode provided to the anode of the diode 517. The third diode 519 has an anode provided to a second output terminal of the filter circuit 134 and a cathode provided to the positive supply line 530. The fourth diode 520 has an anode provided to the negative supply line 531 and a cathode provided to the anode of the diode 519.

A first terminal of a switch 528 is provided to the anode of the diode 519. A second terminal of the switch 528 is provided to a negative terminal of a filter capacitor 521 and to a positive terminal of a filter capacitor 522. A positive terminal of the filter capacitor 521 is provided to the positive supply line 530. A negative terminal of the filter capacitor 522 is provided to the negative supply line 531.

In the system 500, power is supplied to the lamp 507 by a transformer 503 having base windings 504 and 505, and a primary winding 506. A first lead of the base winding 504 is provided via a resistor 510 to a control input of a first switching device (the control input shown as a base of a transistor 501). A second lead of the base winding 505 is provided, via resistor 512, to a control input of a second switching device (the control input shown as a base of a transistor 502). A second lead of the base winding 504 is provided to a first lead of the primary winding 506, and to a collector of the transistor 502. The collector of the transistor 502 is provided via resistor 511 to an emitter of a transistor 501.

A first lead of the base winding 505 is provided via a capacitor 515 to the negative power line 531. The collector of the transistor 501 is provided to the positive power line 530, and the emitter of transistor 502 is provided via a resistor 513 to the negative power line 531. The second lead of the primary winding 506 is provided to a first lead of the first cathode of the discharge lamp 507. A second lead of the first cathode is provided via initiating capacitor 508 and thermistor 529 (the capacitor 508 and thermistor 529 being connected in series) to a first lead of the second cathode of the discharge lamp 507. A second lead of the second cathode is provided to a first terminal of an inductor 509. A second terminal of the inductor 509 is provided to the second terminal of the switch 528.

The thermistor 529 limits the supply of current through the inductor 509 when the lamp 507 is removed or fails to strike.

A start circuit of the system 500 includes a resistor 514, a capacitor 515 and a diode 516. The anode of the diode 516 is provided to the negative supply line 516 and the cathode of the diode 516 is provided to the base of the transistor 502. A first terminal of the resistor 514 is provided to the base of the transistor 502 and a second terminal of the resistor 514 is provided to the positive power line 530. A negative terminal of the capacitor 515 is provided to the first terminal of the base winding 505, and the positive terminal of the capacitor 515 is provided to the negative supply line 531.

The lighting system 500 includes the bypass circuits 108, 110 coupled across respective cathodes of the discharge lamp 507 to extend lamp life. The bypass circuit 108 includes the first diode 335 and the second diode 336. An anode of the first diode 335 is coupled to a cathode of the second diode 336, and an anode of the second diode 336 is coupled to a cathode of the first diode 335. The diodes 335, 336 are coupled across the terminals of the second cathode of the discharge lamp 112. The bypass circuit 110 has the first diode 337 and the second diode 338 in a substantially similar configuration as the bypass circuit 108 described above. The diodes 337, 338 are coupled across the terminals of the first cathode of the discharge lamp 112.

Although shown with a single lamp in FIG. 5, the electronic ballast lighting system 500 can be used to drive multiple lamps as discussed in connection with FIG. 4.

The lighting system 500 can work both from multiple input AC supply voltages, including, for example, U.S. residential style 120 volts and U.S. industrial style 220 volts or, in other words, voltages in the range of approximately 90 volts to approximately 280 volts. The switch 528 is used to select the desired input voltage. The switch 528 is closed to select a lower input voltage (e.g., 120 volts) and the switch 528 is opened to select a higher input voltage (e.g., 220 volts). When the switch 528 is closed the rectifier 532 and filter capacitors 521–522 work in the mode of a voltage doubler. When the switch 528 is open, the rectifier 532 operates as a full wave bridge and the capacitors 521–522 operate as filtering capacitors for the rectifier 532 and the capacitors 521–522 also provide a neutral return point for the lamp currents.

In operation, during the first half cycle, current begins to flow through the inductor 509, the second cathode of discharge lamp 507, the initiating capacitor 508, the thermistor 529, the first cathode of the discharge lamp 507, the primary winding 506, the transistor 502 and the resistor 513. Depending on the charge of the initiating capacitor 508, the current begins to decrease and voltage, induced on base winding 505, switches transistor 502 to an off state. The current then begins to flow in the opposite direction until the voltage across the capacitor 508 again limits the current, causing the direction of current to change again. In this way, the form of the current through the initiating capacitor 508 and the inductor 509 is approximately sinusoidal; and the current, flowing through the transistors 501–502 during switching is relatively small. The current, flowing through cathodes of the discharge lamp 507, heats the cathodes. The inductor 509 and the capacitor 508 form a series-resonant L-C circuit. As the switching frequency of the transistors 501, 502 approaches the resonant frequency of the series-resonant circuit, a relatively high initiating voltage appears at the initiating capacitor 508, which causes the lamp 507 to start. Once the discharge lamp 507 is started, the current flows through the lamp 507 and the capacitor 508 is in parallel, resulting in a decrease in the current through the capacitor 508. When the discharge lamp 507 is lit, its impedance is provided in parallel to the initiating capacitor 508. Current to heat the cathodes of the lamp 507 still flows through the initiating capacitor 508. Shunting by the lamp 507 of the initiating capacitor 508 results in change of the resonance conditions, and the oscillation frequency decreases to the working frequency. Once the lamp is lit, the working frequency of operation becomes relatively lower in comparison with the initial frequency, as the working frequency is a function of the magnetic properties of the transformer 503. The start circuit, includes the resistor 514, the capacitor 515 and the diode 516, and provides initiation of the oscillator circuit when the power is supplied.

Then the discharge lamp 507 is absent (or fails to strike), current through transistors 501–502 is higher than when the lamp 507 is operating. This higher current will cause the transistors 501–502 to dissipate additional heat and may cause overheating of the transistors. To reduce this effect, the thermistor 529 is provided. The thermistor 529 has an increasing resistance with temperature. Thus, when the temperature is relatively lower, the thermistor 529 has a relatively lower impedance chosen to allow proper starting of the lamp 507. When the temperature is relatively higher, the thermistor 529 has a relatively higher impedance chosen to limit the current below the maximum current allowed level for the transistors 501–502.

Although described above in connection with particular embodiments of the present invention, it should be understood that the descriptions of the embodiments are illustrative of the invention and are not intended to be limiting. For example, the use of bipolar transistors for the switching devices used in the above disclosure of the full-wave and half-wave bridge circuits was provided by way of explanation and not by way of limitation. One of ordinary skill in the art will realize that other types of switching devices can be used with appropriate drive circuits. Other types of switching devices include, for example, field-effect transistors, metal-oxide field effect transistors, insulated gate bipolar transistors, etc. Various modifications and applications may occur to those skilled in the art without departing from the true spirit and scope of the invention.

What is claimed is:

1. An energy-efficient ballast for a discharge lamp comprising:

a full-wave rectifier circuit configured to receive an alternating current input voltage and to provide a substantially direct current supply voltage;

a plurality of semiconductor switches coupled to the substantially direct current supply voltage in an H-bridge configuration; and a feedback control circuit configured to control the plurality of semiconductor switches to provide an alternating current to the discharge lamp, wherein the feedback control circuit comprises:

a transformer with a primary winding coupled between a first output of the plurality of semiconductor switches in the H-bridge configuration and a first cathode of the discharge lamp, wherein a plurality of secondary windings is coupled to respective control inputs of the plurality of semiconductor switches;

a capacitor coupled between the first cathode and a second cathode of the discharge lamp; and an inductor coupled between the second cathode of the discharge lamp and a second output of the plurality of semiconductor switches in the H-bridge configuration.

2. The energy efficient ballast of claim 1, further comprising a start-up circuit coupled to the substantially direct current supply voltage and configured to provide a pulse to the feedback control circuit at power up to initialize a sequence of operation for the plurality of semiconductor switches.

3. The energy efficient ballast of claim 1, further comprising a pair of diodes placed in parallel opposition across leads of a cathode of the discharge lamp, wherein the diodes are substantially inactive when the cathode is operational and become active to allow continuing operation of the discharge lamp when the cathode is non-operational.

4. The energy efficient ballast of claim 1, wherein the amplitude of the alternating current input voltage is varied to provide dimming of the discharge lamp.

5. An inverter to drive a discharge lamp, the inverter comprising:

four switching circuits in a bridge configuration, wherein the four switching circuits operate in pairs to provide an alternating current signal to the discharge lamp;

a transformer, wherein a primary winding of the transformer is coupled between a first node of the bridge and a first pin of a first electrode of the discharge lamp and four secondary windings are coupled to respective control terminals of the four switching circuits;

an inductor coupled between a second node of the bridge and a second pin of a second electrode of the discharge lamp; and a timing capacitor coupled between a second pin of the first electrode and a first pin of the second electrode.

6. The inverter of claim 5, wherein the switching circuits are bipolar transistors with external base and emitter resistors for current control.

7. The inverter of claim 5, further comprising bypass circuits coupled across pins of respective electrodes to extend the life of the discharge lamp.

8. The inverter of claim 5, further comprising a start-up circuit configured to provide a trigger signal to the control terminal of one of the switching circuits.

9. The inverter of claim 8, wherein the start-up circuit comprises a capacitor which charges at a relatively slow rate to raise a voltage of an avalanche device to output the trigger signal when power is provide to the inverter and the inverter is not oscillating at a relatively fast rate.

10. An electronic ballast to operate multiple discharge lamps in parallel, the electronic ballast comprising:

a first semiconductor switch coupled in series with a second semiconductor switch across a direct current power supply;

a third semiconductor switch coupled in series with a fourth semiconductor switch across the direct current power supply, wherein the first and the fourth semiconductor switches and the second and the third semiconductor switches operate in pairs to provide alternating current signals to the discharge lamps;

a transformer with a primary winding coupled between a first node commonly connecting the first and the second semiconductor switches and commonly provided first terminals of first cathodes of the respective discharge lamps, wherein secondary windings of the transformer are coupled to control terminals of the semiconductor switches;

a plurality of inductors coupled between a second node commonly connecting the third and the fourth semiconductor switches and respective second terminals of second cathodes of the discharge lamps; and a plurality of capacitors coupled between respective second terminals of the first cathodes and first terminals of the second cathodes.

11. The electronic ballast of claim 10, further comprising a plurality of bypass circuits coupled across terminals of respective cathodes.

12. The electronic ballast of claim 10, further comprising a start-up circuit coupled to a secondary winding of the transformer to ensure reliable operation of the electronic ballast.

13. The electronic ballast of claim 10, wherein the direct current power supply is provided by a rectifier coupled to an alternating current power line.

14. An energy-efficient ballast for a discharge lamp comprising:

a rectifier circuit configured to receive either of a relatively higher alternating current input voltage or a relatively lower alternating current input voltage, and to provide a substantially direct current supply voltage;

a plurality of semiconductor switches coupled to the substantially direct current supply voltage in a half-wave bridge configuration; and a feedback control circuit configured to control the plurality of semiconductor switches to provide an alternating current to the discharge lamp, wherein the feedback control circuit comprises:

a transformer with a primary winding coupled between a first output of the plurality of semiconductor switches in the half-wave bridge configuration and a first cathode of the discharge lamp, wherein a plurality of secondary windings is coupled to respective control inputs of the plurality of semiconductor switches;

a series circuit comprising a capacitor and a thermistor, said series circuit coupled between the first cathode and a second cathode of the discharge lamp; and an inductor coupled between the second cathode of the discharge lamp and a power return terminal of said rectifier circuit.

15. The energy efficient ballast of claim 14, further comprising a start-up circuit coupled to the substantially direct current supply voltage and configured to provide a signal to the feedback control circuit at power-up to initiate operation of at least one semiconductor switch in the plurality of semiconductor switches.

16. The energy efficient ballast of claim 14, further comprising a pair of diodes placed in parallel opposition across leads of a cathode oft e discharge lamp.

17. An inverter to drive a discharge lamp, the inverter comprising:

at least two switching circuits in a push-pull configuration, wherein the switching circuits operate in a push-pull fashion to provide an alternating current signal to the discharge lamp;

a transformer, wherein a primary winding of the transformer is coupled between a first node of the bridge and a first pin of a first electrode of the discharge lamp and secondary windings are coupled to respective control terminals of the switching circuits;

an inductor coupled between a second node of the bridge and a second pin of a second electrode of the discharge lamp; and a thermistor circuit in parallel with said discharge lamp to limit current in one or more of said switching circuits.

18. The inverter of claim 17, wherein the switching circuits comprise bipolar transistors with external base and emitter resistors for current control.

19. The inverter of claim 17, further comprising bypass circuits to extend the life of the discharge lamp.

20. The inverter of claim 17, further comprising a start-up circuit configured to provide a signal to the control terminal of at least one of the switching circuits.

* * * * *